US005403239A

United States Patent [19]

Zimmers

[11] Patent Number: 5,403,239

[45] Date of Patent: Apr. 4, 1995

[54] WHEELED SEESAW DEVICE

[76] Inventor: Tighe Zimmers, 5736 N. East Circle, Chicago, Ill. 60631

[21] Appl. No.: 160,776

[22] Filed: Dec. 3, 1993

[51] Int. Cl.[6] ..... A63G 11/00

[52] U.S. Cl. ..... 472/106; 472/108; 472/109

[58] Field of Search ..... 472/106, 108, 111, 112, 472/109, 4, 5; 446/322; 104/79, 80; D21/251

[56] References Cited

U.S. PATENT DOCUMENTS

| | | | |
|---|---|---|---|
| D. 220,115 | 3/1971 | Semler | 472/106 X |
| 1,380,893 | 6/1921 | Gebert | 472/106 X |
| 1,434,850 | 11/1922 | Smith | 472/4 |
| 2,184,097 | 12/1939 | Grampp | 472/106 |
| 2,544,589 | 3/1951 | Cummings | 472/4 |

FOREIGN PATENT DOCUMENTS

| | | | |
|---|---|---|---|
| 201800 | 8/1923 | United Kingdom | 472/106 |

*Primary Examiner*—Carl D. Friedman
*Assistant Examiner*—Kien Nguyen
*Attorney, Agent, or Firm*—Edward D. Gilhooly

[57] ABSTRACT

A wheeled seesaw amusement device having a tubular frame with telescopic sections capable of having vary length. The tubular sections interconnect at opposite ends to form contact sections with the ground. The frame is supported by an axle mounting a pair of wheels and by strut members pivotally carried by the axle. The position of the strut members relative to the frame can be varied to alter the vertical height of the frame.

9 Claims, 3 Drawing Sheets 2
4
4a
6
8
10
12
12a
14
20
22
24
26
26a
28
29
30
32
34
36
40
42

WHEELED SEESAW DEVICE

BACKGROUND OF THE INVENTION

1. Field of the Invention

This invention relates in general to amusement devices and more specifically, to a wheeled seesaw device.

2. Summary of the Prior Art

Seesaws or teeter totters are popular amusement devices typically having a board that is pivoted at a center axis for upward and downward movement by riders sitting on opposite ends. Attempts have been made in the past to attach wheels at the pivot point of a seesaw to allow the device to move along a surface as well as up and down. Past designs of wheeled seesaws are cumbersome and relatively heavy, and are not economical to manufacture and to use. Known seesaws of this type generally have a fixed frame which is incapable of convenient adjustment of its length. Prior wheeled seesaws are also difficult to operate and do not provide optimum safety protection for their riders, particularly children. Accordingly, it is desirable in the art to provide an improved wheeled seesaw having a light weight design and improved characteristics of adjustability, enhanced safety, and economy of manufacture.

SUMMARY OF THE INVENTION

It is therefore an objective of the invention to provide an improved wheeled seesaw using telescoping tubular members having an adjustable length and a light weight construction. The tubular design of the invention improves ease of manufacture and efficiency of packaging for transport. The wheeled seesaw herein described is easily handled and maneuvered for both up and down motion and movement along a surface. The height of the seesaw can also be adjusted to fit the sizes of riders of various age groups. The tubing at both ends of the frame or main spar is shaped to cushion the rider if the seesaw impacts the ground. The frame or spar is designed having a parallel tube configuration to provide an opening for greater visibility of the ground, an added safety feature. The T-shaped handle of the invention is intended to strike the ground first in event of a tip over and protect the riders' legs from striking the ground.

DESCRIPTION OF THE PREFERRED EMBODIMENT

Figures 1, 5:
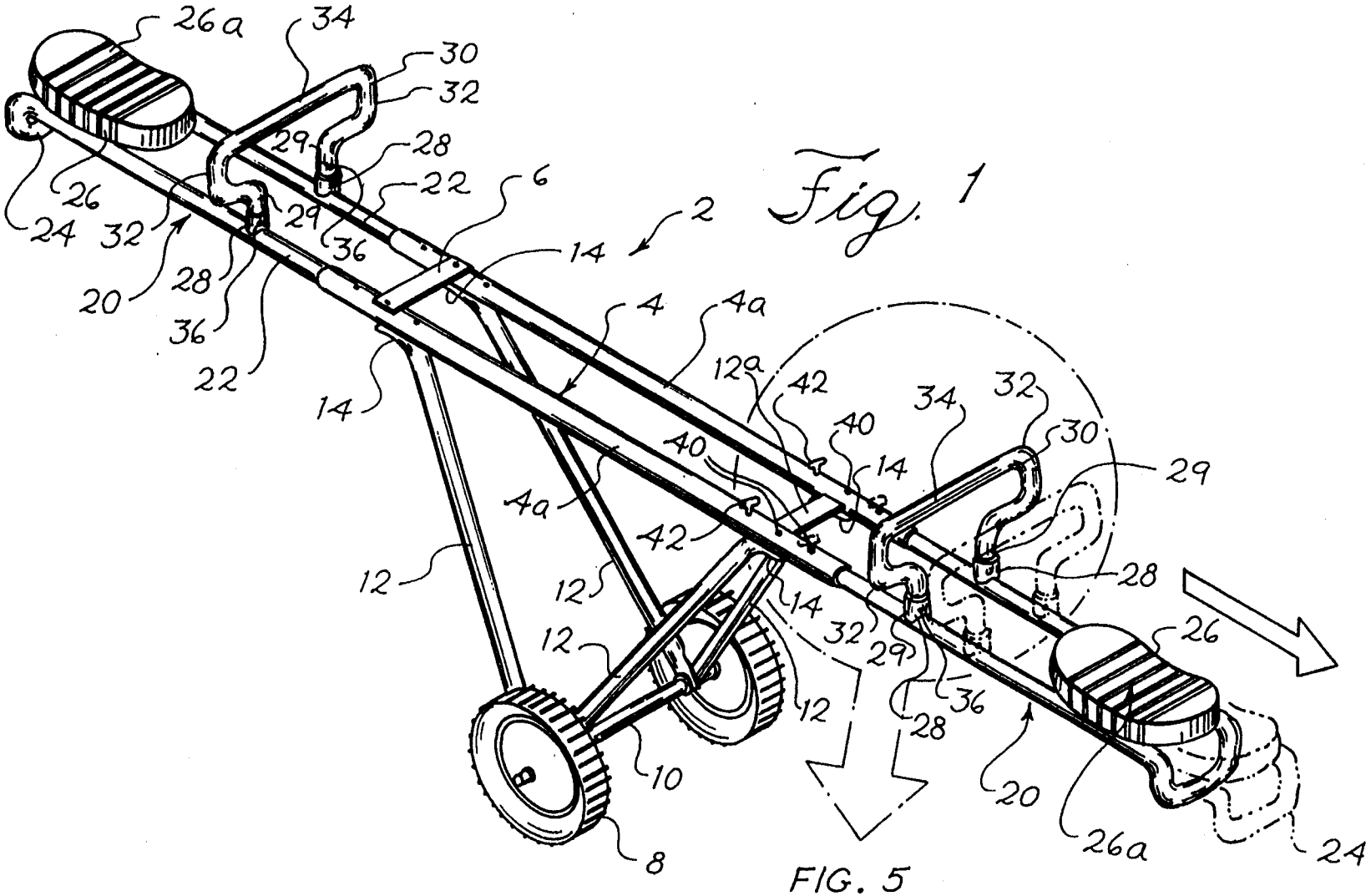
FIG. 1 is a front perspective view, with parts in phantom, of the wheeled seesaw device of the invention.
FIG. 5 is an enlarged perspective view of detail 5 of FIG. 1.
Figure 2:
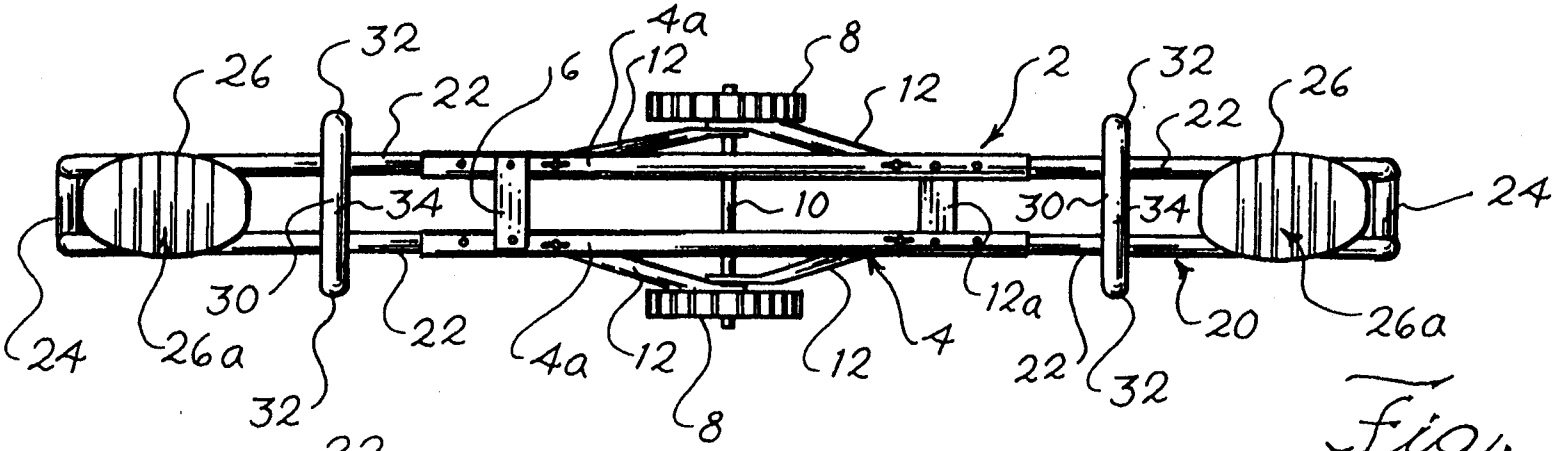
FIG. 2 is a top plan view of the wheeled seesaw device of FIG. 1.
Figure 3:
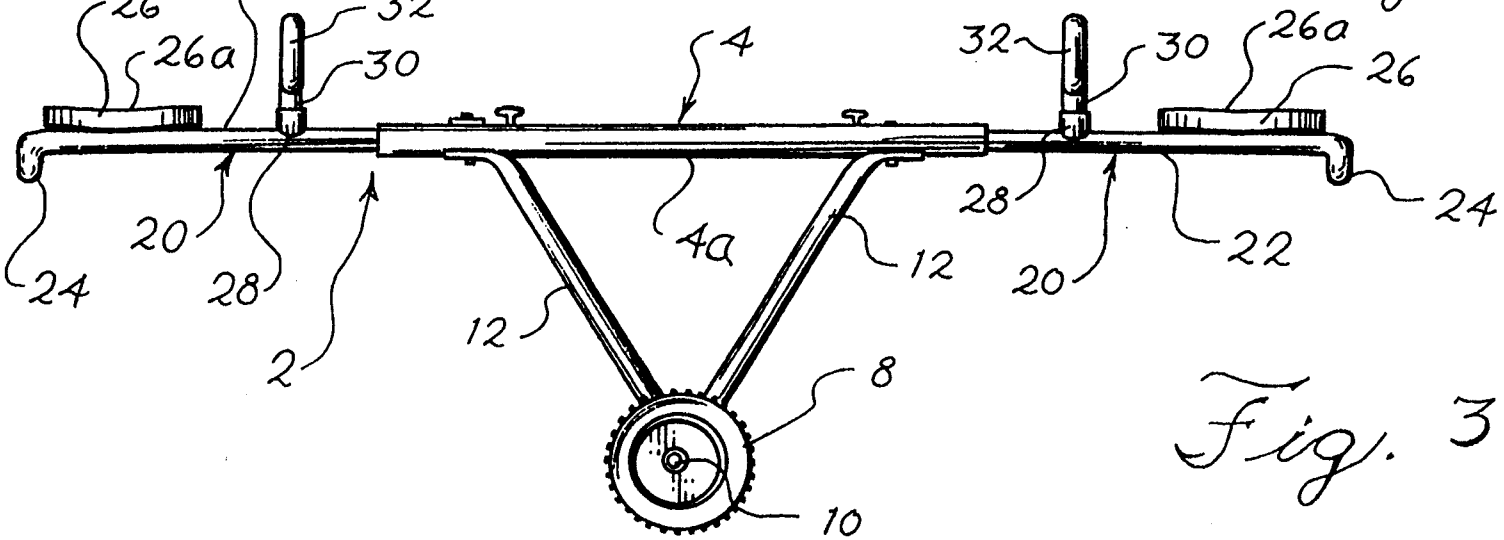
FIG. 3 is a side elevational view of the wheeled seesaw device of FIG. 1.
Figure 5:
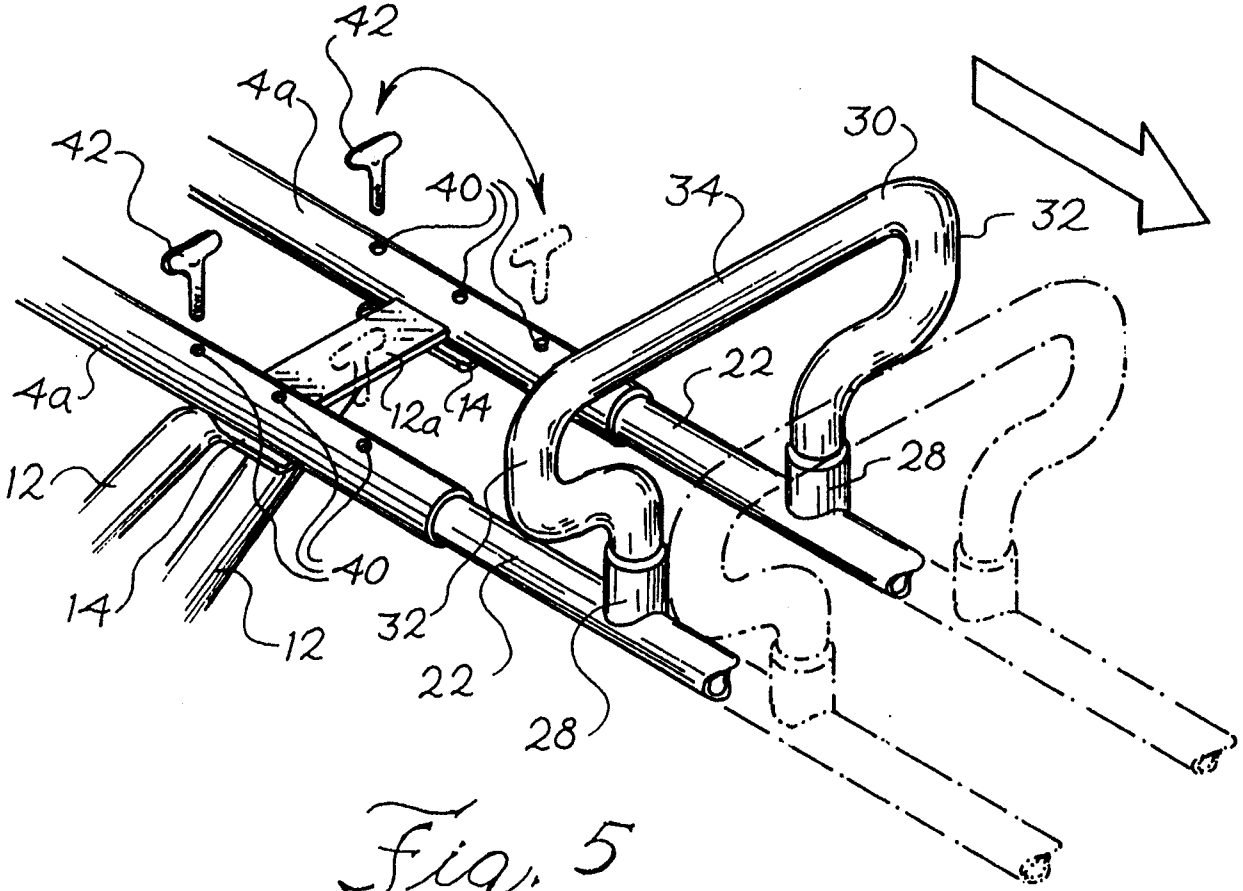
Figure 4:
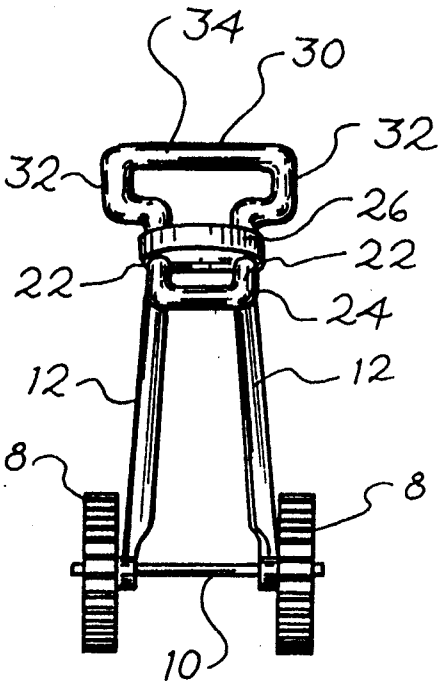
FIG. 4 is an end elevation view of the wheeled seesaw device of FIG. 1.

Referring now to FIGS. 1 to 5, there is illustrated the improved wheeled seesaw device of the invention, generally designated by reference numeral 2. The wheeled seesaw 2 includes a main frame or spar 4 having intermediate parallel tubular members 4*a* interconnected together by a pair of flat bars 6, one of which is shown in FIG. 1. The main frame 4 is supported by a pair of wheels 8 rotatably carried on bearings (not shown) by an axle 10. A pair of angularly arranged struts 12 are pivotally attached to axle 10 on each side of seesaw 2 and have upper horizontal portions 14 affixed to the main from 4 in a manner to be described. The pair of struts 12 on each side may be reinforced by a lower bar 12*a*, one of which is shown in FIG. 2.

The frame or spar 4 further includes a pair of opposed tubular frame extensions 20 that telescopically interfit with the open ends of intermediate tubular members 4*a*. Each of the tubular extensions 20 have a pair of parallel portions 22 which are interconnected at their outer ends by integral downwardly rounded sections 24 projecting below the plane of the tubular sections 20. The rounded sections 24 are designed to cushion the impact in the event that they strike the ground and provide enhanced comfort and safety.

A seat 26 having a gently concave seat area 26*a* is suitably affixed by conventional fasteners (not shown) to the top of both tubular extensions 20 immediately within lower rounded sections 24. A pair of upper collars 28 are attached by a suitable metal attachment technique to each of the tubular extensions 20 at a position between the seat 26 and the intermediate tubular members 4*a*. The collars 28 receive the lower end portion 29 of a modified T-shaped tubular handle 30 forming outwardly projecting portions 32 on both lateral sides of the seesaw and a upper horizontal handle area 34 for the rider. The outward projecting portions 32 laterally extend sufficiently to form ground contact areas in the event the seesaw 2 tips over as a protection to the legs of the rider. The lower end portion 29 of handle 30 are telescopically received in collars 28 and are retained by a threaded fastener, such as a nut and bolt, extending through hole 36 in collar 28 (FIG. 1) in alignment with a hole (not shown) in the lower inserted portion 29 of handle 30.

As seen in FIGS. 1 and 5, the adjustability features of the wheeled seesaw 2 are best illustrated. Each of the intermediate tubes 4*a* have a plurality of aligned holes 40, such as three in number, to receive winged threaded members 42 to extend therethrough and engage a hole in the upper horizontal portion 14 of a respective strut 12 for retention. The end portions of tubular extensions 20 are also provided with respective holes (not shown) which in turn are aligned with a selected one of holes 40 to permit the winged threaded members 42 to secure the tubular extensions 20 and the struts 12 to the intermediate frame 4*a* as a unit. The length of the frame 4 toward and away from the axle 10 can be adjusted by simply altering which of the holes 40 is aligned with the internal holes of the tubular extension 20 through which a winged fastener 42 is affixed.

The position of the struts 12 with respect to intermediate tubular members 4*a* can also be altered if the length of frame 4 is changed with a resulting variation of the height of the frame, whereby the frame is lowered when the struts are attached further away from axle 10. The height of the frame 4 can be maintained independently by using additional threaded members (not shown) to attach the upper portions 14 to other holes 42 other than the holes in which the threaded member 42 retains a tubular extension 20. In such situations, additional holes (not shown) are needed in the insert ends of the tubular extensions 22 to automatically align them with an adjacent hole of the intermediate members 4*a* and allow the struts 12 to be located at a position different than used to retain the tubular extensions 22. This adjustment maintains a given height regardless of the length of frame 4 or permits independent adjustment of the height of the frame 2 from the ground or other surface.

What is claimed is:

1. A wheeled seesaw amusement apparatus comprising a frame having a plurality of tubular members having opposite free ends, said tubular members being interconnected to form a unitary structure, said frame being carried by a pair of wheels, said pair of wheels being rotatably mounted on an axle extending transverse of said frame at its approximate midpoint between said free ends, strut means being pivotally attached to said axle and having upper end portions rigidly affixed against movement to the underside of said tubular members, a pair of seats being respectively carried by said plurality of tubular members adjacent said opposite ends of said tubular members, said frame being capable of being raised and lowered about said axle at said free ends and being propelled along a support surface by riders on said seats, said tubular members include intermediate tubular portions and opposite tubular extensions forming said free ends, said tubular extensions telescopically engaging said intermediate tubular portion, and said tubular extensions are adjustable though said telescopic engagement relative to said intermediate tubular members to vary the distance between said free ends.

2. The apparatus according to claim 1 further comprising means to lock said tubular extensions at plurality of positions relative to said intermediate tubular members.

3. The apparatus according to claim 1 wherein said plurality of tubular members comprises two parallel members having a pair of intermediate tubular members and a pair of tubular extensions at each end of said intermediate tubular members.

4. The apparatus according to claim 1 wherein said free ends of said pair of tubular extensions are formed by tubular end portions projecting downward from said frame and an integral tubular cross member interconnecting said pair of tubular extensions portions at each of said free ends, said tubular cross member being disposed beneath said seat for striking the ground.

5. The apparatus according to claim 1 wherein said strut means include a pair of strut members having lower ends pivotally mounted on said axle and having upper ends connected to each of said tubular members respectively on opposite sides of said approximate midpoint of said frame.

6. The apparatus according to claim 5 further comprising adjustment means for affixing said upper ends of said pair of strut members at selected positions along said frame from said midpoint for varying the height of said frame.

7. The apparatus according to claim 1 further including a pair of upright handle members respectively affixed to said tubular extensions between said seat and said intermediate tubular members, said handle members projecting laterally outward on both sides of said frame beyond said seats to form an area to contact the surface.

8. The apparatus according to claim 7 wherein said tubular extensions respectively include a pair of upwardly opening collars for receiving said upright handle members for support.

9. The apparatus according to claim 8 wherein said pair of upright handle members comprise an integral tubular member having lower ends for insertion into said collars.

* * * * *